US006089378A

United States Patent [19]

Mascheretti et al.

[11] Patent Number: 6,089,378

[45] Date of Patent: Jul. 18, 2000

[54] DEVICE AND PROCESS FOR SEPARATING IMPURITIES FROM TEXTILE FIBERS IN PNEUMATIC TRANSPORT LINES

[75] Inventors: Mario Mascheretti; Giovanni Battista Pasini, both of Palazzolo Sull'Oglio, Italy

[73] Assignee: Marzoli S.p.A., Palazzolo Sull'Oglio, Italy

[21] Appl. No.: 09/398,824

[22] Filed: Sep. 20, 1999

[30] Foreign Application Priority Data

Sep. 18, 1998 [IT] Italy ..... MI98A2024

[51] Int. Cl.[7] ..... B07B 7/04

[52] U.S. Cl. ..... 209/143; 209/134; 209/135; 209/136; 209/137; 209/142; 406/157; 406/159

[58] Field of Search ..... 209/134, 135, 209/136, 137, 142, 143; 406/160, 157, 159, 168, 175

[56] References Cited

U.S. PATENT DOCUMENTS

| | | | |
|---|---|---|---|
| 694,431 | 3/1902 | Schroeder | 209/143 |
| 1,525,760 | 2/1925 | Rushton | 209/137 |
| 1,870,042 | 8/1932 | Dorfan | 209/142 |
| 2,162,392 | 6/1939 | Solomon et al. | 209/137 |
| 2,681,477 | 6/1954 | Van Doorn | 209/143 |
| 2,696,911 | 12/1954 | Umney | 209/142 |
| 3,747,985 | 7/1973 | Merkel et al. . | |
| 3,956,106 | 5/1976 | Muck et al. | 209/134 |
| 4,534,368 | 8/1985 | Labbe | 131/110 |
| 4,685,942 | 8/1987 | Klassen et al. | 55/306 |
| 5,358,121 | 10/1994 | Robak et al. | 209/137 |
| 5,934,478 | 8/1999 | Mitsumura et al. | 209/143 |

FOREIGN PATENT DOCUMENTS

| | | | |
|---|---|---|---|
| 0 364 786 | 4/1990 | European Pat. Off. . | |
| 2 499 103 | 8/1982 | France . | |
| 140704 | 3/1980 | Germany | 209/143 |
| 1169758 | 7/1985 | U.S.S.R. | 209/136 |
| 2 260 145 | 4/1993 | United Kingdom . | |

*Primary Examiner*—Donald P. Walsh
*Assistant Examiner*—David Jones
*Attorney, Agent, or Firm*—Oblon, Spivak, McClelland, Maier & Neustadt, P.C.

[57] ABSTRACT

A device and process for separating impurities from textile fibers during horizontal pneumatic transport is provided. The device includes a hollow parallelepiped separator of rectangular cross-section for the passage of transport fluids, such as air, therethrough. The passage section is subdivided into an upper part, for the cleaned fluid, and a lower part, for the separation of the impurities (i.e., foreign materials) in a hopper intercepted by an extractor having a seal. This subdivision is regulated by a deflector knife which induces an S-shaped motion of the transport fluid 4 and separates the impurities (i.e., foreign materials) by centrifugal force.

9 Claims, 2 Drawing Sheets

DEVICE AND PROCESS FOR SEPARATING IMPURITIES FROM TEXTILE FIBERS IN PNEUMATIC TRANSPORT LINES

BACKGROUND OF THE INVENTION

1. Field of the Invention

The present invention generally relates to devices and processes for the processing of raw fibers, wherein the raw fibers are to be prepared in blow room machines for supply to carding operations, and more particularly, to devices and processes for opening the fibrous material of the raw fibers, in flake form, to form a single fiber by preparing a sliver of substantially parallelized fibers, and wherein a majority of the impurities and contamination have been removed from the raw fibers so that the raw fibers may be sent on for subsequent processing thereof.

2. Description of the Background

The processing stations for processing the baled fibrous material are connected to each other by pneumatic transport lines. The pneumatic transport lines use a stream of transport fluid, such as air, to lift the fibrous material, which is more or less in the form of coarse flakes, together with all of the contents of the flakes including impurities, contamination, short fibers, metallic and non-metallic materials, and other foreign material (hereinafter collectively called "impurities"). Together, the fibrous material and impurities are moved between the various bins which supply the individual blow room machines.

In prior art devices and processes, the reduction and separation of such impurities from the fibers substantially take place during the processing of the fibers in the blow room machines, such as collectors, blenders, openers, etc. The blow room machines have, for instance, suction openings, separator knives, and separation grilles, etc., which gradually remove the impurities from the fibers in flake form via centrifugal force.

SUMMARY OF THE INVENTION

More specifically, the present invention relates to a device and a process for separating impurities from textile fibers during pneumatic transportation thereof. Preferably, the separating device is to be inserted into the horizontal pneumatic transport lines connecting the processing machines.

In its most general aspects, the present invention makes use of the fact that the impurities to be removed from the fibers have a lower lifting effect with respect to the transport fluid. This is both because of the density of the impurities, which density is greater than the density of the fibers, and because of the shape of the impurities. Thus, the impurities tend to undergo a grading action by settling towards the bottom, particularly in the absence of significant turbulence.

A phenomenon is known, for example, wherein the horizontal sections of the pipes of circular cross-section, which are normally used in the pneumatic transport units for the fibers being processed, because of the lower lifting effect, the heavy impurities (i.e., foreign materials) move onto the bottom of the pipes and concentrate predominantly in a lower zone of much reduced cross-section, generally delimited by a chord of the transverse cross-section having a length of 40–50% of the diameter of the circular duct.

The present invention relates more particularly to a system for separating impurities (i.e., heavy foreign materials), constituted by metallic and non-metallic parts and contamination, to be inserted into the pipes of pneumatic transport ducts which connect the various stages of the processing of the fibers in flake form.

According to the present invention, a system is directed towards the overall improvement of processing the raw fibers. The system includes the above-described device having essential characteristics and various embodiments. The device performs the above-described process having essential characteristics and various embodiments.

BRIEF DESCRIPTION OF THE DRAWING FIGURES

To illustrate the characteristics and advantages of the present invention more clearly, the present invention will be described with reference to a typical embodiment shown in FIGS. 1 to 3, by way of a non-exhaustive example.

DETAILED DESCRIPTION OF THE PREFERRED EMBODIMENTS

Figure 1:
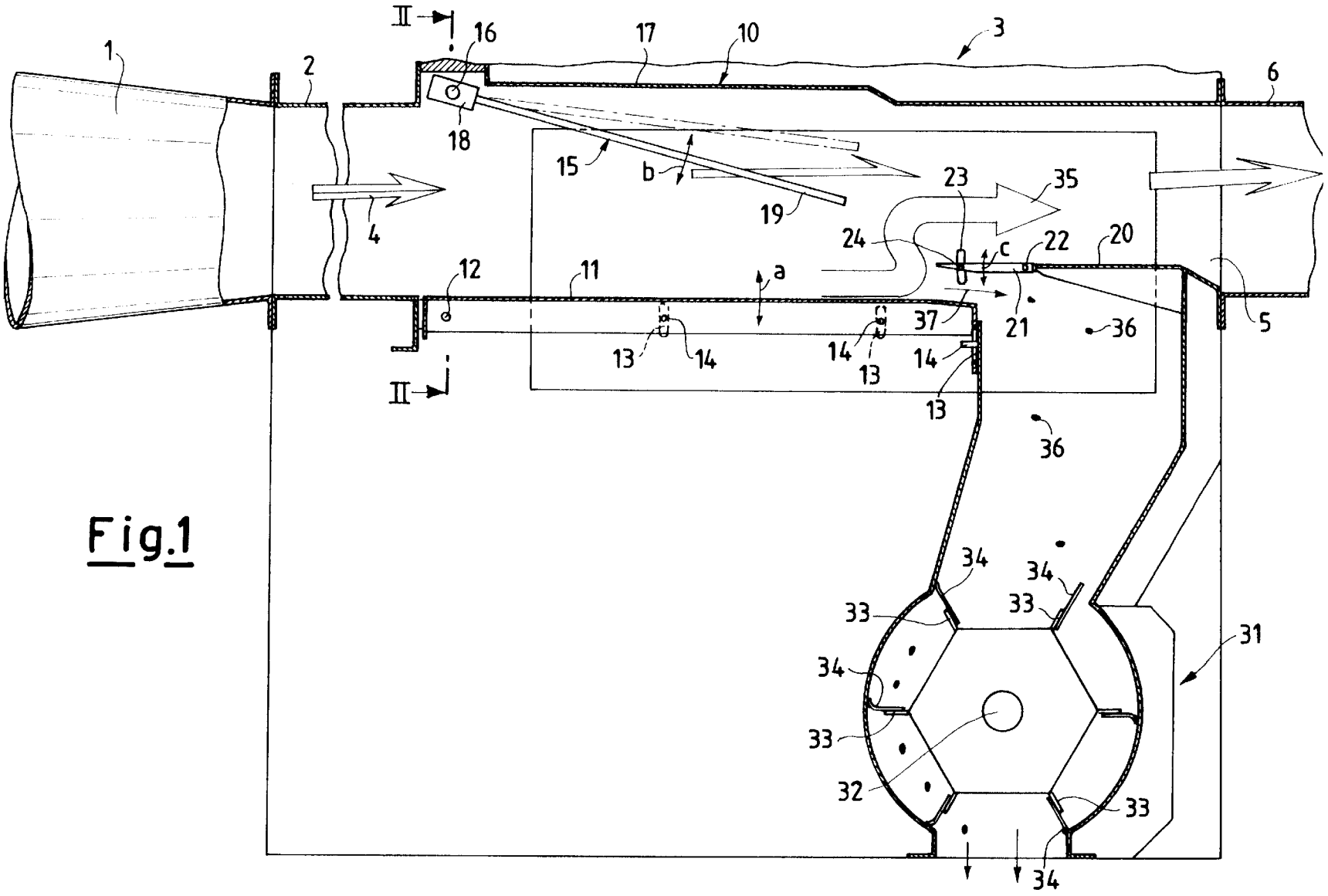
FIG. 1 is a side view of a separator 3 of the present invention.

In the embodiments of the above-described figures, the separator of the present invention includes a connection 1, which connects the pipe of circular cross-section, to a duct 2 of equivalent rectangular cross-section. This configuration aids the above-described phenomenon of grading the particles of lower lift with respect to the fibers in flake form. The duct 2 is connected to the body of the separator 3 which discharges the stream of transport fluid 4 (i.e., air) from the opening towards the rectangular duct 6. The rectangular duct 6 continues transporting the fibers toward the machine downstream.

The body of the separator 3 includes a hollow containment parallelepiped 10 of rectangular cross-section. The rectangular cross-section of the hollow containment parallelepiped 10 of the separator 3 is consistent with the cross-section of the ducts 2 and 6. A lower wall 11 of the hollow containment parallelepiped 10 of the separator 3 is fulcrum-mounted at a pin 12. The lower wall 11 is movable so as to be able to regulate the size of the area of passage available for the flow of the fluid which passes through the separator 3 in a horizontal direction.

The angular position of the lower wall 11 is fixed as a function of the desired adjustment in a conventional manner. For example, the angular position of the lower wall 11 may be fixed by one or more slots 13 and fixing screws 14. This allows for a pivoting movement of the lower wall 11 in the directions indicated by double-sided arrow a, and also ensures the tightness of the adjacent lateral walls of the separator 3.

Figure 2:
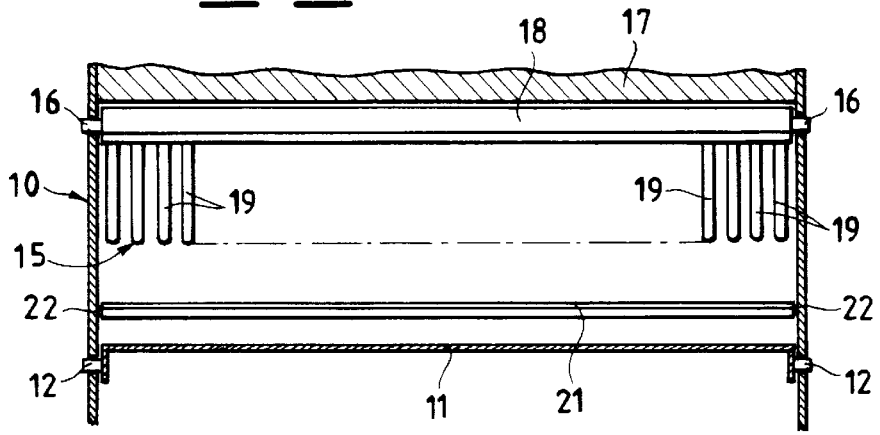
FIG. 2 is a cross-sectional view taken along line II—II of FIG. 1 showing details of an interception rack 15 of the separator 3.

The flow of the transport fluid 4 is directed from left to right as shown in FIG. 1. The flow of the transport fluid 4 encounters a rack 15 which is fulcrum-mounted at a fulcrum 16 adjacent to an upper wall 17 of the hollow containment parallelepiped 10 of the separator 3. The details of the rack 15, as shown in FIG. 2, include, for example, a transverse bar 18, which contains the pin 12 on which the rack 15 is fulcrum-mounted. The rack 15 has a set of parallel and rounded bars 19 which extend towards the bottom so as to partially intercept the passage of the transport fluid 4 in the body of the separator 3, for the entire height of the hollow containment parallelepiped 10, which forms a passage section, and more particularly, for an upper section of the passage section. The angular position of the rack 15 is fixed as a function of the desired adjustment in a conventional manner and the rack 15 pivots in the directions indicated by double-sided arrow b.

A right hand part of the passage section of the hollow containment parallelepiped 10 of the separator 3 is subdivided into two parts (i.e., an upper part and a lower part). The upper part is intended for the transport fluid 4, which continues towards the right, while the lower part is intended for the separation of the impurities (i.e., foreign materials).

The subdivision of the section of the separator 3 occurs when the wall 20 is substantially parallel to the upper wall 17 of the hollow containment parallelepiped 10 and when the wall 20 is located slightly higher with respect to the lower movable wall 11. A left hand end of the passage section of the hollow parallelepiped 10 includes a movable deflector knife 21. The movable deflector knife 21 is fulcrum-mounted at a pin 22 and extends for the entire opening of the passage of the fibers inside of the hollow containment parallelepiped 10. The angular position of the knife 21 is fixed as a function of the desired adjustment in a conventional manner. For example, the angular position of the knife 21 may be fixed via slot 23 and fixing screws 24 so that the knife 21 is pivotably movable in the directions indicated by double-sided arrow c.

Thus, the movable knife 21 subdivides the height available for the passage of the fluid into two parts, namely, an upper part of height y and a lower part of height x. The values of the heights x and y are adjusted, both in terms of magnitude and in terms of relation to each other, by the adjustments of the positions of the movable wall 11 and the movable knife 21.

The lower section of the passage of height x emerges into a hopper 30 to collect the separated material. The bottom of the hopper 30 is intercepted by an extractor 31 having a seal. The extractor 31 may be a rotary extractor constituted by a rotary body 32. The rotary body 32 includes a plurality of vanes 33 equipped with flexible seal membranes 34 which slide against a containment surface. The sliding of the flexible seal membranes 34 against the containment surfaces allows discharge of the solids separated material from the spaces formed between the vanes 33 to the outside, but does not allow the flow of the transport fluid 4 to escape. The extractor 31 rotates at low speed having an order of magnitude of about one revolution per minute.

The upper section of the passage of height y is not intercepted and faces instead towards the outlet opening 5. The upper section of the passage of height y is intended for the transport flow of the fibers, in flake form, from which the impurities (i.e., foreign materials) have been removed.

The process for separating impurities (i.e., foreign materials) proceeds as follows. Referring to the enlarged view of FIG. 3, the transport flow in the duct 2 and in the body of the hollow containment parallelepiped 10 concentrates and contains the heavier impurities in a lower part thereof, together with a significant quantity of the fibers, in flake form, which should not be discharged. This grading effect, or settling, of the impurities during pneumatic transportation of the fibers is intensified by the flattened rectangular cross-section of the duct 2 and of the body of the hollow containment parallelepiped 10.

The mechanism of the separation between fibers, in flake form, and impurities (i.e., foreign materials) takes place chiefly because of the knife 21. This creates an obstacle to the advance of the mixed phase of fibers and impurities which tend to enter into the lower passage and thence into the hopper 30. This advance is obstructed by the fact that the opening 5 is free and permits the outflow of the transport fluid 4 (i.e., air), while the hopper 30 is blocked by the extractor or rotary shutter 31. A pressure differential is thus established between the two spaces. Through the effect of this obstruction, the flow of transport fluid 4 (i.e., air), which lifts the fibers, in flake form, and the impurities (i.e., foreign materials), finds no outlet and is returned towards the upper passage and the opening 5.

Figure 3:
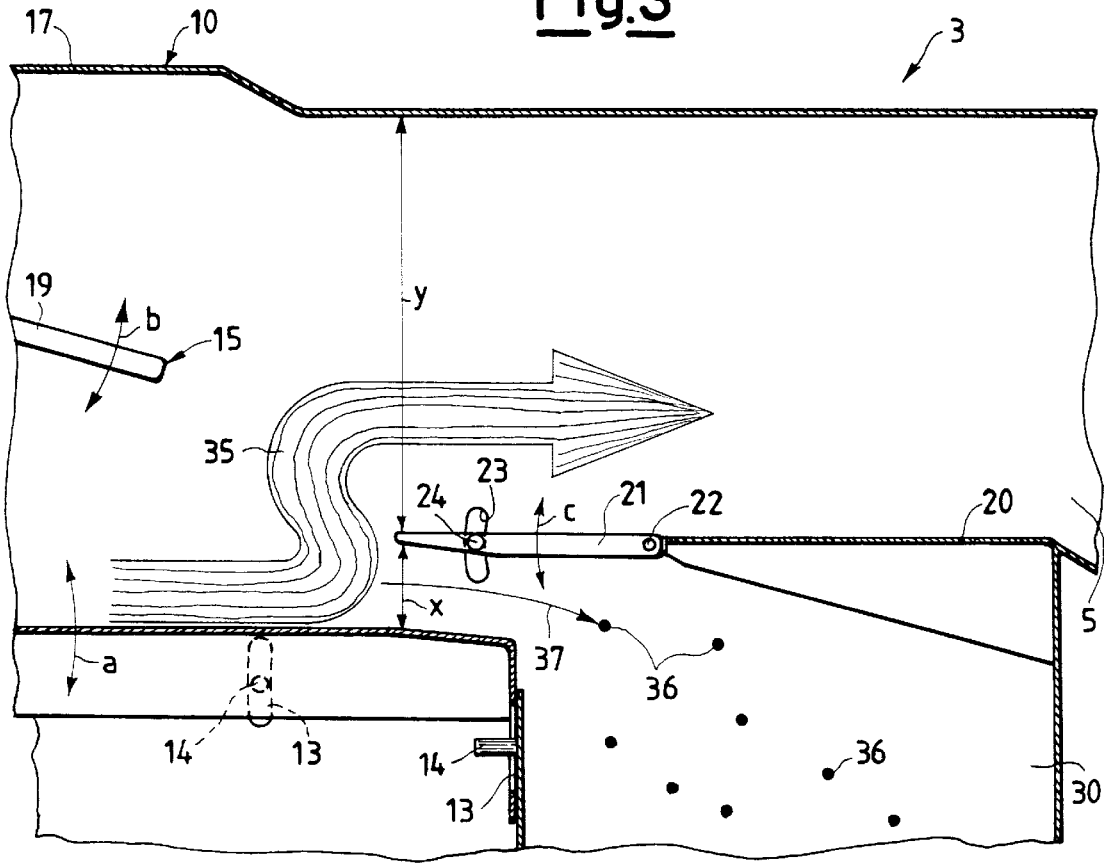
FIG. 3 is an enlarged view of the movable knife 21 of FIG. 1, wherein a deflection of the flow takes place during which the impurities (i.e., particles of foreign material) are separated from the fibers by fluid dynamics.

The S-shaped course of the flow 35, shown in FIG. 3, compels the transport fluid 4 (i.e., air) to make two changes of direction substantially at 180° with respect to each other. The S-shaped course of flow 35 is obtained by first moving the transport fluid 4 (i.e., air) in a circular motion having a diameter d on the order of the height x. This sudden deflection generates a significant centrifugal force on the material transported, producing a separation effect as a function of the weight and shape of the particles transported, and of the velocity of the transport fluid 4 (i.e., air).

The particles of separated impurities 36 (i.e., foreign material) are denoted by the dots which separate the main flow of the S-shaped course 35 according to trajectories 37, as shown in FIG. 3.

This separation takes place because the changes of direction of the heavier part, or that which requires a greater lifting effect, detaches from the transport flow and enters the hopper 30. In contrast, the lighter part, or the fibers, in flake form, which require less lift, succeed in following the flow deflected according to the S-shaped course 35 and follow the stream of transport fluid 4 (i.e., air) towards the opening 5 and the duct 6.

This cleaning effect also extends to the impurities entangled in the flakes of the fibers. The impurities are significantly detached from the flakes in the course of the sudden deflection of the flow and the impurities are thrust towards the opening of height x.

To extend the separation effect to the entire mass of fibers transported in the separator 3, a preferred embodiment of the present invention provides the use of the rack 15 hinged at the fulcrum 16. The rack 15 preferentially deflects toward the knife 21 as the fibers, in flake form, are being transported pneumatically by the transport fluid 4. In the course of the deflection of the rack 15, the detachment of the impurities (i.e., foreign particles) from the flakes of the fibers is also promoted.

The rack 15 is lowered to intercept the passage of the fibers via bars 19. The passage of the fibers is deflected towards the upper part of the body of the hollow containment parallelepiped 10 in accordance with the passage of height y. This deflects the majority of the fibrous material towards the knife 21. However, the insertion of the fibrous material between the bars 19 does not interrupt the flow of the air is not interrupted and the flow regime is not significantly interfered with. Further, the effect of grading the impurities towards the bottom is also not interfered with.

Generally speaking, the rack 15 is angularly adjusted in either of the directions indicated by double-sided arrow b. Therefore, the bars 19 of the rack 15 affect a part thereof, which is variable between 25 and 70% of the height x+y of the section available for the passage of the transport fluid 4.

The impurities (i.e., foreign materials) separation effect is also regulated on the basis of the requirement to transport the fibrous material efficiently in line and not to lose significant quantities of valuable fibers. Therefore, an effective compromise is chosen to take account of the above-stated requirements. To this end, the distances x and y and the ratio x/y are determined using the angular positions of the wall 11 and the knife 21.

With the adjustment of the angular position of the lower wall 11, the height x+y, which is available overall for the transit of the flow of transport fluid 4, is also regulated and the fluid dynamics conditions in the separator 3 are also influenced. Both the height x and the residual height y, and the ratio x/y, are regulated with the adjustment of the angular position of the knife 21. The adjustment of the rack 15 enables the flakes of fibers which are traveling in the highest part of the station to be carried towards the bottom. Still, in general terms, this adjustment is made on the basis of the impurities and contamination content of these fibers. If the spontaneous grading of the impurities (i.e., foreign materials) in the duct 2 upstream proves already to be sufficient, the requirement to lower the rack 15 to deflect the fibers is lessened.

In general terms, for the separators 3 to be inserted into the transport lines between the blow room machines of normal capacity, the value of the height x is adjusted between 10 and 70 mm, and preferably between 20 to 50 mm. The values of the ratio x/y are kept in the range of from 0.25 to 0.70, and preferably between 0.3 and 0.5.

Still in general terms, a higher value of the height x enables a larger quantity of impurities to be caught in the hopper 30, but less selectivity. This would also involve losing a larger quantity of fibers in flake form. If valuable fibers are being processed, the material discharged with the extractor or shutter 31 should then be handled to recover the lost fibers. With high values of height x, the S-shaped course of flow 35 has less abrupt deflections and a gentler course, and the separation is greater, but less selective.

Substantial advantages are obtained with the device according to the present invention, especially as follows.

The device is capable of performing a significant cleaning of the flakes of fibers during the pneumatic transport thereof such as to safeguard and mitigate the task of the blow room machines and the lickers-in of the carders and affords them a greater service factor, because of the lower maintenance required to clean and repair the clothings, knives, openings, and filters.

The device and the process for cleaning in line are easily adjustable and adaptable to the different batches of fiber which are brought for processing.

What is claimed is:

1. A separating device for separating impurities from textile fibers in flake form during pneumatic transportation thereof, wherein said separating device is located between ducts connecting machines for processing the textile fibers, said separating device comprising:

a hollow containment parallelepiped of rectangular cross-section having an upper wall which is stationary and a lower wall which is pivotable, wherein said rectangular cross-section of said hollow containment parallelepiped is consistent with a cross-section of said ducts connecting said machines to said hollow containment parallelepiped;

a rack fulcrum-mounted at a fulcrum at said upper wall so as to be pivotable within said hollow containment parallelepiped;

a passage section of said hollow containment parallelepiped having a variable area, wherein said variable area of said passage section is regulated by pivoting said lower wall for passage of fluids through said separating device in a horizontal direction, and wherein said separating device is divided into an upper part and a lower part, said upper part being of a first predetermined height for the fluids, after having impurities separated therefrom, to continue moving downstream through said separating device and said lower part being of a second predetermined height for capturing the impurities separated from the textile fibers;

a hopper for collecting the impurities separated from the textile fibers, wherein said hopper is intercepted by an extractor having a seal; and a movable deflector knife which extends from a wall inside of said hollow containment parallelepiped.

2. The separating device according to claim 1, wherein said lower wall has an angular position which is adjusted by pivoting said lower wall to ensure adjacent lateral walls of the separator remain tightly held against said lower wall.

3. The separating device according to claim 1, wherein said movable deflector knife is fulcrum-mounted to a wall by a pin so that an angular position of said movable deflector knife is pivotably adjustable.

4. The separating device according to claim 1, wherein an extractor has a seal and said extractor is a rotary extractor constituted by a rotary body comprising a plurality of vanes which have spaces formed between adjacent vanes and which are equipped with flexible seal membranes, said flexible seal membranes sliding against a containment surface for discharging the impurities collected in said spaces formed between said plurality of vanes to an outside of said separating device.

5. The separating device according to claim 1, wherein said rack includes a series of bars which extend partially to intercept the fluids passing through said separating device, particularly in an upper section thereof.

6. The separating device according to claim 5, wherein an angular position of said rack is pivotably adjustable.

7. A process for separating impurities from textile fibers in flake form during pneumatic transportation thereof using a separating device located between ducts connecting machines for processing the textile fibers, wherein said separating device includes a hollow containment parallelepiped of rectangular cross-section having an upper wall which is stationary and a lower wall which is pivotable, wherein said rectangular cross-section of said hollow containment parallel epiped is consistent with a cross-section of said ducts connecting said machines to said hollow containment parallelepiped, a rack fulcrum-mounted at a fulcrum at said upper wall so as to be pivotable within said hollow containment parallelepiped; a passage section of said hollow containment parallelepiped having a variable area, wherein said variable area of said passage section is regulated by pivoting said lower wall for passage of fluids through said separating device in a horizontal direction, and wherein said separating device is divided into an upper part and a lower part, said upper part being of a first predetermined height for the fluids, after having impurities separated therefrom, to continue moving downstream through said separating device and said lower part being of a second predetermined height for capturing the impurities separated from the textile fibers, a hopper for collecting the impurities separated from the textile fibers, wherein said hopper is intercepted by an extractor having a seal, and a movable deflector knife which extends from a wall inside of said hollow containment parallelepiped, said process comprising the steps of:

adjusting a value of said second predetermined height between 10 and 70 mm, and preferably between 20 and 50 mm.

8. The process for separating impurities from textile fibers according to claim 7, further comprising keeping a ratio of said first predetermined height to said second predetermined height within a range of from 0.25 to 0.70, and preferably between 0.3 and 0.5.

9. The process for separating impurities from textile fibers according to claim 7, further comprising adjusting bars of said rack between 25 and 70% of a total height of said first predetermined height and said second predetermined height of said passage section of the fluids of said separating device.

* * * * *